US010755690B2

(12) United States Patent
Mohammad et al.

(10) Patent No.: US 10,755,690 B2
(45) Date of Patent: Aug. 25, 2020

(54) DIRECTIONAL NOISE CANCELLING HEADSET WITH MULTIPLE FEEDFORWARD MICROPHONES

(71) Applicant: QUALCOMM Incorporated, San Diego, CA (US)

(72) Inventors: Asif Mohammad, San Diego, CA (US); Catalin Lacatus, San Diego, CA (US); Deepak Kumar Challa, San Diego, CA (US); Louis Dominic Oliveira, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 26 days.

(21) Appl. No.: 16/004,881

(22) Filed: Jun. 11, 2018

(65) Prior Publication Data

US 2019/0378491 A1 Dec. 12, 2019

(51) Int. Cl.
*G10K 11/178* (2006.01)
*H04R 1/10* (2006.01)

(52) U.S. Cl.
CPC .. *G10K 11/17823* (2018.01); *G10K 11/17827* (2018.01); *G10K 2210/1081* (2013.01); *G10K 2210/3026* (2013.01); *G10K 2210/3027* (2013.01); *G10K 2210/3044* (2013.01); *G10K 2210/3046* (2013.01); *H04R 1/1008* (2013.01)

(58) Field of Classification Search
CPC .. H04R 1/1008; H04R 1/1016; H04R 1/1083; H04R 1/1091; H04R 2410/01; H04R 2410/03; H04R 2410/05; H04R 2410/07; G10K 11/17815; G10K 11/17823; G10K 11/17851; G10K 11/17857; G10K 11/17885; G10K 2210/1081; G10K 2210/3026; G10K 2210/3027; G10K 2210/3045; G10K 2210/3046; G10K 2210/3226
USPC ..... 381/71.6, 71.1, 71.2, 71.8, 71.9, 71.13, 381/71.14, 74, 123
See application file for complete search history.

(56) References Cited

U.S. PATENT DOCUMENTS 6,522,753 B1 * 2/2003 Matsuzawa ..... G10K 11/178 381/123
8,447,045 B1 * 5/2013 Laroche ..... A61F 11/14 381/71.1

(Continued)

FOREIGN PATENT DOCUMENTS

CN 207184757 U 4/2018
KR 20170085874 A 7/2017

*Primary Examiner* — Xu Mei
(74) *Attorney, Agent, or Firm* — Moore Intellectual Property Law, PLLC

(57) ABSTRACT

A headphone device includes a speaker housing, a first feedforward microphone, and a second feedforward microphone. The first feedforward microphone is coupled to the speaker housing at a first location, and the second feedforward microphone is coupled to the speaker housing at a second location. The headphone device also includes an active noise cancelling (ANC) circuit configured to generate an anti-noise signal based on at least one of a first signal from the first feedforward microphone and a second signal from the second feedforward microphone. The headphone device also includes a speaker configured to generate an audio output at least partially based on the anti-noise signal.

22 Claims, 6 Drawing Sheets

(56) References Cited

U.S. PATENT DOCUMENTS

| | | | | |
|---|---|---|---|---|
| 8,611,552 | B1 * | 12/2013 | Murgia | H04R 1/1083 381/71.14 |
| 8,693,700 | B2 * | 4/2014 | Bakalos | G10K 11/178 381/58 |
| 9,318,093 | B2 * | 4/2016 | Goto | G10K 11/178 |
| 9,706,288 | B2 * | 7/2017 | Terlizzi | H04R 1/1091 |
| 9,747,887 | B2 * | 8/2017 | O'Connell | G10K 11/17881 |
| 9,837,066 | B2 * | 12/2017 | Wurtz | G10K 11/17881 |
| 2008/0049953 | A1 * | 2/2008 | Harney | H04R 1/245 381/94.7 |
| 2010/0272276 | A1 * | 10/2010 | Carreras | G10K 11/178 381/71.6 |
| 2011/0158419 | A1 * | 6/2011 | Theverapperuma | G10K 11/17885 381/71.1 |
| 2012/0051548 | A1 | 3/2012 | Visser et al. | |
| 2012/0250882 | A1 * | 10/2012 | Mohammad | H04B 3/234 381/94.1 |
| 2012/0300955 | A1 * | 11/2012 | Iseki | G10K 11/178 381/71.4 |
| 2013/0073283 | A1 | 3/2013 | Yamabe | |
| 2014/0126733 | A1 | 5/2014 | Gauger, Jr. et al. | |
| 2018/0286374 | A1 * | 10/2018 | Cattell | G10K 11/17881 |

* cited by examiner

DIRECTIONAL NOISE CANCELLING HEADSET WITH MULTIPLE FEEDFORWARD MICROPHONES

I. FIELD

The present disclosure is generally related to a noise cancelling headset.

II. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These mobile devices can communicate voice and data packets over wireless networks. Further, many such devices incorporate additional functionality such as a digital still camera, a digital video camera, a digital recorder, and an audio file player. Also, such mobile devices can process executable instructions, including software applications, such as a web browser application, that can be used to access the Internet. As such, these mobile devices can include significant computing capabilities.

A mobile device may include active noise cancelling (ANC) headsets. ANC headsets provide noise cancellation by creating an anti-noise signal to at least partially cancel ambient sound. An ANC headset may have a feedforward configuration in which a feedforward microphone is used to detect ambient sound prior to mixing the ambient sound with the anti-noise signal, a feedback configuration in which a feedback microphone is used to detect residual sound after mixing with the anti-noise signal, or a hybrid configuration that uses both a feedforward microphone and a feedback microphone. However, none of the configurations (feedforward, feedback, or hybrid) are capable of providing directional noise cancellation. Therefore, a user cannot selectively cancel noise from one direction without canceling noise from another direction. For example, a jogger is unable to cancel ambient noise from in front of the jogger (for improved comfort) while not cancelling noise from behind the jogger (for increased safety).

III. SUMMARY

According to one implementation of the techniques disclosed herein, a headphone device includes a speaker housing, a first feedforward microphone, and a second feedforward microphone. The first feedforward microphone is coupled to the speaker housing at a first location, and the second feedforward microphone is coupled to the speaker housing at a second location. The headphone device also includes an active noise cancelling (ANC) circuit configured to generate an anti-noise signal based on at least one of a first signal from the first feedforward microphone and a second signal from the second feedforward microphone. The headphone device also includes a speaker configured to generate an audio output at least partially based on the anti-noise signal.

According to another implementation of the techniques disclosed herein, a method includes generating, at an active noise cancelling (ANC) circuit of a headphone device, an anti-noise signal based on at least one of a first signal from a first feedforward microphone and a second signal from a second feedforward microphone. The first feedforward microphone is coupled to a first location of a speaker housing of the headphone device, and the second feedforward microphone is coupled to a second location of the speaker housing. The method also includes generating an audio output at least partially based on the anti-noise signal.

According to another implementation of the techniques disclosed herein, a non-transitory computer-readable medium includes instructions that, when executed by a processor within an active noise cancelling (ANC) circuit of a headphone device, cause the processor to perform operations including generating an anti-noise signal based on at least one of a first signal from a first feedforward microphone and a second signal from a second feedforward microphone. The first feedforward microphone is coupled to a first location of a speaker housing of the headphone device, and the second feedforward microphone is coupled to a second location of the speaker housing. The operations also include generating an audio output at least partially based on the anti-noise signal.

According to another implementation of the techniques disclosed herein, a headphone device includes means for capturing first noise from a first direction and means for capturing second noise from a second direction. The headphone device also includes means for generating an anti-noise signal based on at least one of a first signal from the means for capturing the first noise and a second signal from the means for capturing the second noise. The headphone device also includes means for generating an audio output at least partially based on the anti-noise signal.

One advantage of the above-described implementations is directional noise cancellation at a headphone device. For example, a jogger may adjust a control to suppress noise originating from the front (e.g., within the jogger's sight) but to not suppress noise originating from behind (e.g., outside of the jogger's sight), providing the jogger with an enhanced experience due to reduced noise from noise sources visible to the jogger without compromising the jogger's safety by cancelling noise from unseen noise sources (e.g., a car approaching behind the jogger). Other implementations, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "detecting", "estimating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "estimating", "using", "selecting", "accessing", and "determining" may be used interchangeably. For example, "generating", "calculating", "estimating", or "determining" a parameter (or a signal) may refer to actively generating, estimating, calculating, or determining the parameter (or the signal) or may refer to using, selecting, or accessing the parameter (or signal) that is already generated, such as by another component or device.

Figure 1A:
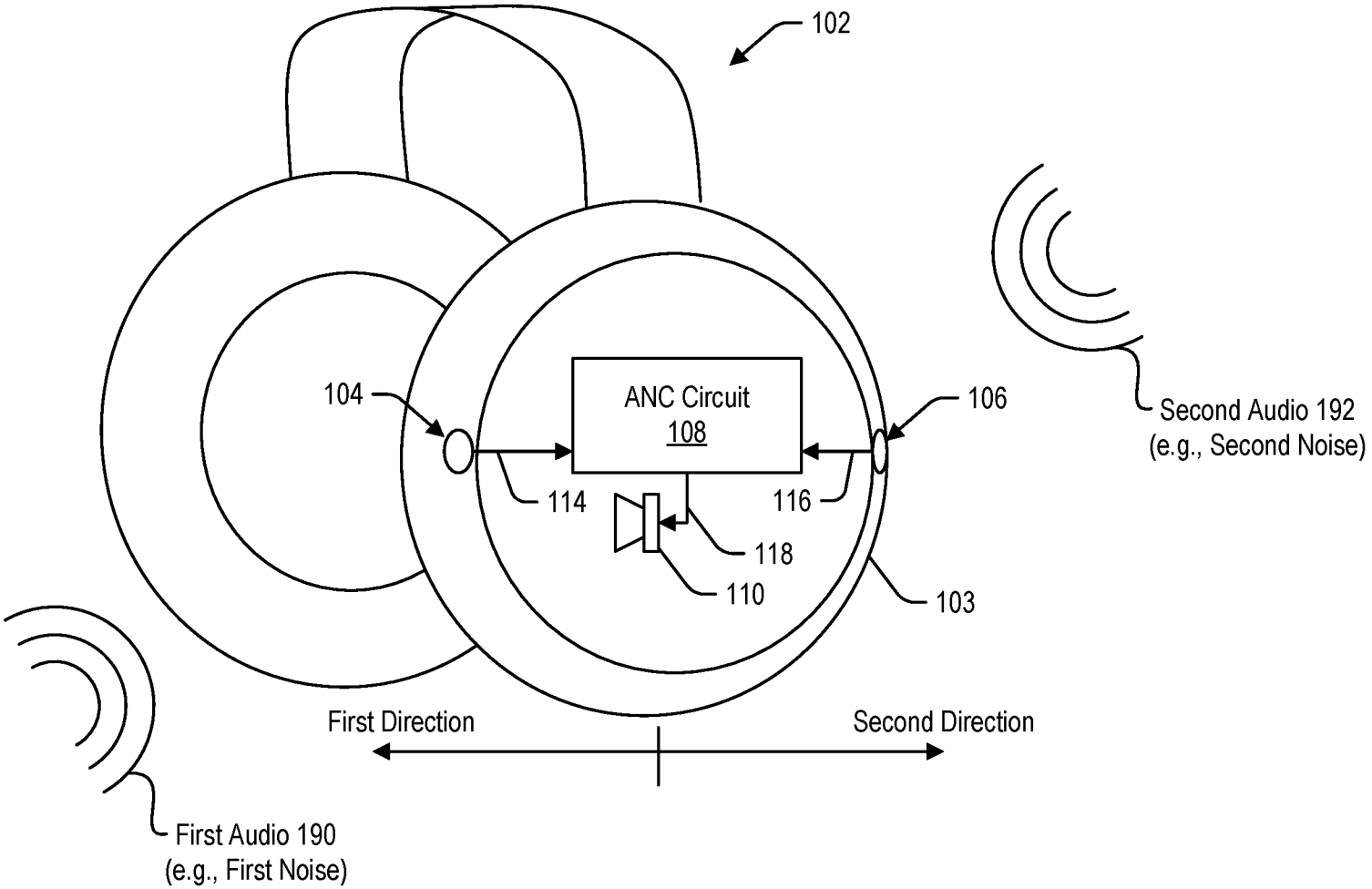
FIG. 1A is an example of a headphone device that is operable to perform directional noise cancellation.

Referring to FIG. 1A, an example of a headphone device 102 that is operable to perform directional active noise cancellation is shown. One or more aspects of the headphone device 102 enable directional noise cancellation, such as to cancel noise from sound sources in front of a wearer of the headphone device 102 but to not cancel noise from sound sources behind the wearer.

The headphone device 102 includes a speaker housing 103, a first feedforward microphone 104 coupled to the speaker housing 103 at a first location, and a second feedforward microphone 106 coupled to the speaker housing 103 at a second location. As illustrated, the first feedforward microphone 104 is oriented towards a first direction (e.g., in front of the wearer) and the second feedforward microphone 106 is oriented towards a second direction (e.g., behind the wearer). The first feedforward microphone 104 may be a directional microphone or an omni-directional microphone. The second feedforward microphone 106 may be a directional microphone or an omni-directional microphone.

The headphone device 102 includes an active noise cancelling (ANC) circuit 108 coupled to the first feedforward microphone 104 and coupled to the second feedforward microphone 106. The ANC circuit 108 is configured to generate an anti-noise signal 118 based on at least one of a first signal 114 from the first feedforward microphone 104 and a second signal 116 from the second feedforward microphone 106. To illustrate, the first feedforward microphone 104 may capture first audio 190 (e.g., first noise) and generate the first signal 114 based on the captured first audio 190. According to one implementation, the first signal 114 is a digital representation of the captured first audio 190. The second feedforward microphone 106 may capture second audio 192 (e.g., second noise) and generate the second signal 116 based on the captured second audio 192. According to one implementation, the second signal 116 is a digital representation of second captured audio 192. As described below, the ANC circuit 108 uses the digital representations (e.g., the signals 114, 116) of the captured audio 190, 192 to generate the anti-noise signal 118 (e.g., a signal that substantially suppresses at least one of the first audio 190 or the second audio 192).

Figure 1B:
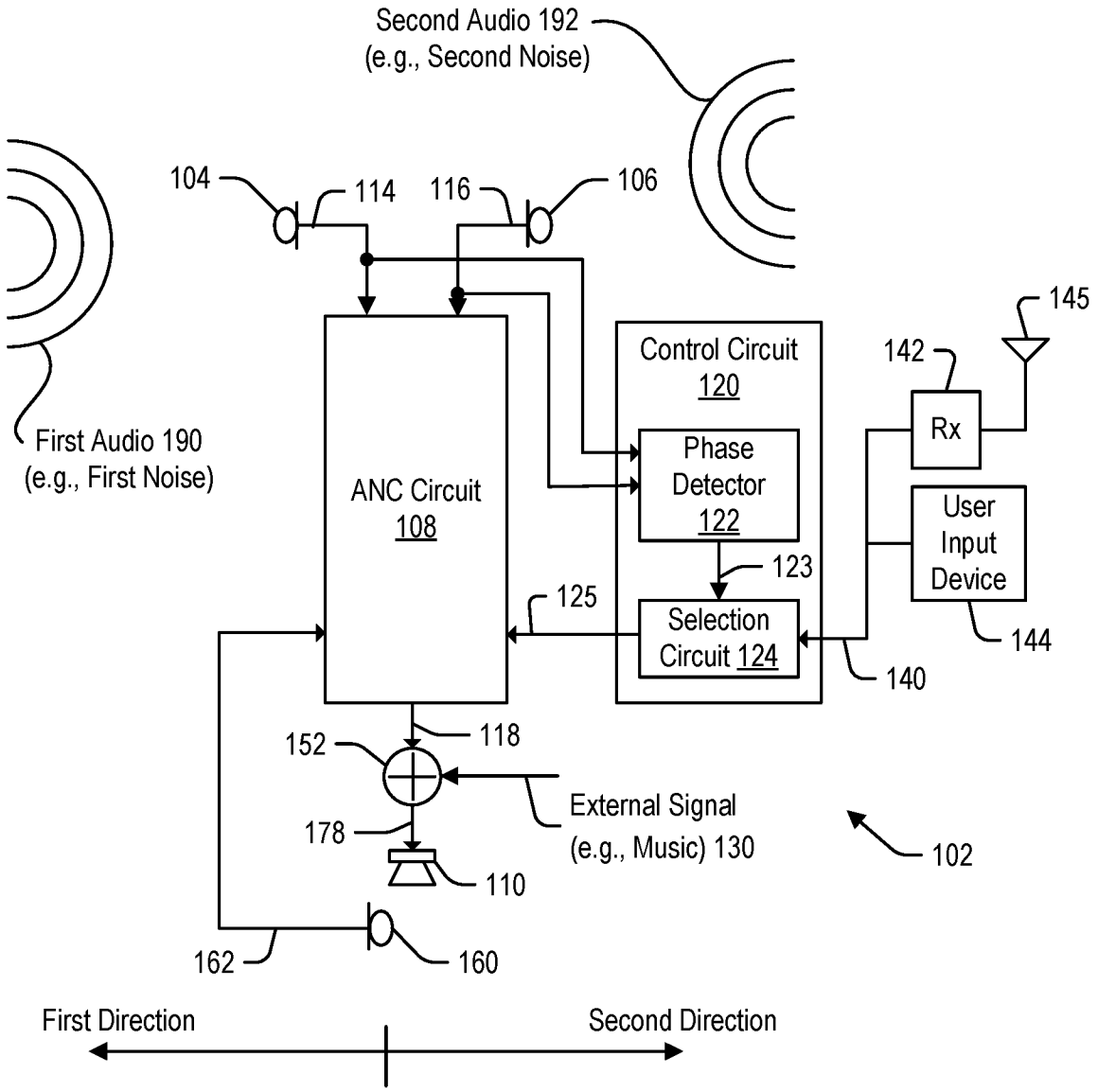
FIG. 1B is another example of the headphone device of FIG. 1A.

As described in greater detail with respect to FIG. 1B, selection of whether to perform noise reduction on the first audio 190 or the second audio 192 may be determined based on an audio phase difference or user selection. However, for ease of illustration, in FIG. 1A, noise reduction is performed on the first audio 190. To perform noise reduction on the first audio 190, the ANC circuit 108 may apply a noise cancellation operation to the first signal 114. For example, the ANC circuit 108 may generate infinite impulse response (IIR) coefficients that, when applied to the first signal 114, generates a signal (e.g., a first portion of the anti-noise signal 118) that substantially suppresses the first audio 190. Additionally, the ANC circuit 108 may apply a pass-through operation on the second signal 116. The pass-through operation may include amplifying the second signal 116 to generate an amplified version of the second signal 116 (e.g., a second portion of the anti-noise signal 118). Thus, performing noise reduction on the first audio 190 includes suppressing the first audio 190 to form on the first portion of the anti-noise signal 118, while the second audio 192 may be passed-through or amplified to form on the second portion of the anti-noise signal 118.

The anti-noise signal 118 is provided to a speaker 110 that is proximate to an ear of the wearer. The speaker 110 is configured to generate an audio output corresponding to the anti-noise signal 118. The audio output actively cancels the first audio 190 (based on the first portion of the anti-noise signal 118) from the first direction and passes through or amplifies the second audio 192 (based on the second portion of the anti-noise signal 118) from the second direction. As a result, a wearer of the headphone device 102 does not hear (or hears a reduce amount of) the first audio 190 and more clearly hears the second audio 192.

Thus, during operation, the wearer of the headphone device 102 may control the headphone device 102 to provide directional noise cancellation. For example, a jogger may adjust a control to suppress noise (e.g., the first audio 190) originating from the front (e.g., within the jogger's sight) but to not suppress noise (e.g., the second audio 192) originating from behind (e.g., outside of the jogger's sight), providing the jogger with an enhanced experience due to reduced noise from noise sources visible to the jogger without compromising the jogger's safety by cancelling noise from unseen noise sources (e.g., a car approaching behind the jogger).

After jogging, the wearer may control the headphone device 102 to provide omni-directional noise cancellation. The ANC circuit 108 may generate the anti-noise signal 118 based on the first signal 114 and the second signal 116 to cancel noises independently of the direction from which the noise is received. As a result, noise from all directions is reduced, improving the user's experience as compared to the headphone device 102 reducing noise from one direction but not reducing noise from another direction. Although components of a single ear-cup of the headphone device 102 are illustrated and described, the other ear-cup of the headphone device 102 can also include multiple feedforward microphones, an ANC circuit, and a speaker arranged in a similar configuration.

The use of multiple feedforward microphones in an ANC headphone device enables functionality that is not available in conventional feedforward ANC systems, conventional feedback ANC systems, and conventional hybrid ANC systems. For example, a conventional feedforward ANC headset system has a single feedforward microphone at the outside of each earcup. The single feedforward microphone captures noise outside of the earcup, and the noise is processed to generate an anti-noise signal that is sent to a speaker within the earcup. Because the feedforward microphone (at the outer surface of the earcup) is relatively distant from the speaker (near the ear), the conventional feedforward ANC system has sufficient time to perform relatively complex filtering and signal processing to generate the anti-noise signal before detected noise reaches the user's ear. However, no self-correction is possible because there is no mechanism to evaluate the effectiveness of the anti-noise signal. As a result, conventional feedforward ANC systems perform relatively accurate filtering, although in a relatively narrow frequency range, and are susceptible to poor performance if the headset is incorrectly worn (e.g., allowing wind noise to reach the ear).

Having a single feedforward microphone per earcup limits conventional feedforward ANC headsets to, at most, a "noise cancellation on" mode and a "noise cancellation off" mode. Using a single feedforward microphone per earcup prevents implementation of the multiple noise cancellation modes (e.g., directional noise cancellation, omni-directional noise cancellation, and no noise cancellation) and multiple directional noise cancellation options (e.g., forward-only, rearward-only, etc.) that are enabled by the multiple-feedforward microphone ANC system of the headphone device 102.

A conventional feedback ANC headset system has a single feedback microphone inside each earcup. The single feedback microphone captures sound near the user's ear, including sound output by the earcup's speaker. The signal captured by the feedback microphone is used to generate an anti-noise feedback signal. Conventional feedback ANC headsets can adapt to noise variations and can reduce noise due to wind entering the earcup but are not as effective at filtering relatively high noise frequencies (e.g., at around 1-2 kilohertz (kHz)) as conventional feedforward ANC headset systems. Having a single feedback microphone per earcup also limits operation of conventional feedback ANC headsets to, at most, a "noise-cancellation on" mode and a "noise cancellation off" mode. Conventional feedback ANC headsets are unable to implement the multiple noise cancellation modes and multiple directional noise cancellation options that are enabled by the multiple-feedforward microphone ANC system of the headphone device 102.

Conventional hybrid ANC headset systems include a single feedforward microphone and a single feedback microphone. The feedforward microphone functions substantially as described for conventional feedforward ANC headset systems and the feedback microphone functions substantially as described for conventional feedback ANC headset systems. Conventional hybrid ANC headset systems can provide benefits of conventional feedforward ANC systems and also benefits of conventional feedback ANC systems, such as noise suppression at a broader range of frequencies, ability to adapt to noise variations, and reduced sensitivity to incorrect wearing of the earcup. Thus, combining the functionality of the feedforward microphone and the functionality of the feedback microphone results in a two-microphone ANC system that can provide the benefits of the feedforward microphone and also the benefits of the feedback microphone. However, although a conventional hybrid ANC headset system includes two microphones, the arrangement of the microphones as a feedforward microphone and a feedback microphone prevents the conventional hybrid ANC headset system from providing the multiple noise cancellation modes and the multiple directional noise cancellation options that are enabled by the multiple-feedforward microphone ANC system of the headphone device 102.

FIG. 1B illustrates an example of components that may be implemented in the headphone device 102 (e.g., in an ear-cup of the headphone device 102) and includes the ANC circuit 108, the first feedforward microphone 104, the second feedforward microphone 106, and the speaker 110. A control circuit 120 is configured to provide a selection signal 125 to the ANC circuit 108. The selection signal 125 indicates which audio (e.g., the first audio 190, the second audio 192, or both) is to be (substantially) suppressed and which audio 190, 192 is to be passed through or amplified.

The control circuit 120 includes a phase detector 122 and a selection circuit 124. According to one implementation, the selection circuit 124 is configured to receive an indication signal 123 from the phase detector 122. The phase detector 122 is configured to generate the indication signal 123 based on a phase difference between a first phase of the first audio 190 captured at the first feedforward microphone 104 and a second phase of the first audio 190 captured at the first feedforward microphone 104. Based on the phase difference, the phase detector 122 determines that the first feedforward microphone 104 is closer to a sound source of the first audio 190 than the second feedforward microphone 106. As a result, the indication signal 123 indicates that the first feedforward microphone 104 should be associated with the first audio 190. The phase detector 122 may perform similar operations to determine that the second feedforward microphone 106 should be associated with the second audio 192.

The selection circuit 124 is configured to receive a direction selection signal 140 from an input device 144 (e.g., a button, slider, switch, touchscreen, or other control device) coupled to the speaker housing 103 or from a wireless receiver 142 coupled to an antenna 145. For example, the wireless receiver 142 may receive the direction selection signal 140 via a wireless communication from a smartphone or other device having a headphone configuration application. The direction selection signal 140 indicates a particular direction (e.g., the first direction of the second direction) in which to cancel noise. Thus, a wearer of the headphone device 102 can control the headphone device 102 to perform directional noise cancellation or to perform omni-directional noise cancellation.

The selection circuit 124 generates the selection signal 125 based on the received direction selection signal 140, based on the indication signal 123, or both. For example, if the direction selection signal 140 indicates that the wearer of the headphone device 102 selected to suppress noise originating from the first direction, the selection circuit 124 may generate, based on the indication signal 123, a first value of the selection signal 125 to suppress the first audio 190 and to amplify the second audio 192. As another example, if the direction selection signal 140 indicates that the wearer of the headphone device 102 selected to suppress noise originating from the second direction, the selection circuit 124 may generate, based on the indication signal 123, a second value of the selection signal 125 to suppress the second audio 192 and to amplify the first audio 190.

The selection signal 125 may include or indicate a first set of filter coefficients to control filtering of the first signal 114, a second set of filter coefficients to control filtering of the second signal 116, one or more amplifier gain parameters to amplify, invert, or attenuate the first signal 114, the second signal 116, the filtered first signal, the filtered second signal, or any combination thereof. For ease of illustration, in FIG. 1B, noise reduction is performed on the first audio 190 (e.g., the selection circuit 124 generates the first value of the selection signal 125 to suppress the first audio 190). However, it should be understood that in other implementations, similar techniques may be applied to perform noise reduction on the second audio 192.

To perform noise reduction on the first audio 190, the ANC circuit 108 may apply a noise cancellation operation to the first signal 114. For example, the first value of the selection signal 125 may enable filter coefficients (e.g., IIR coefficients) to control filtering of the first signal 114. The ANC circuit 108 is configured to apply the filter coefficients to the first signal 114 to generate a first filtered signal (not shown). The first filtered signal corresponds to a first portion of the anti-noise signal 118 output by the ANC circuit 108. When output by the speaker 110, audio related to the first filtered signal substantially suppresses the first audio 190 such that the wearer of the headphone device 102 does not hear (or hears a reduced amount of) the first audio 190.

Additionally, in conjunction with performing noise reduction on the first audio 190, the ANC circuit 108 may apply one or more gain amplifier parameters to the second signal 116. For example, the first value of the selection signal 125 may include gain amplifier parameters to control amplification of the second signal 116. The ANC circuit 108 is configured to apply the gain amplifier parameters to the second signal 116 to generate a second amplified signal (not shown). The second amplified signal corresponds to a second portion of the anti-noise signal output by the ANC circuit 108. When output by the speaker 110, audio related to the second amplified signal amplifies the second audio 192 such that the wearer of the headphone device 102 more clearly hears the second audio 192.

Thus, the anti-noise signal 118 includes a signal to substantially suppress noise from the first feedforward microphone 104 and a pass-through signal of audio from the second feedforward microphone 106. The anti-noise signal 118 is provided to a combiner 152. According to one implementation, the combiner 152 includes an adder, a mixer, or both, to combine the anti-noise signal 118 with another audio signal. In FIG. 1B, the combiner 152 combines the anti-noise signal 118 with an external signal 130, such as an audio channel of a playback device, to generate an output signal 178. The external signal 130 may include music rendered by the headphone device 102.

The speaker 110 is configured to output audio associated with the output signal 178. The audio output by the speaker 110 substantially suppresses the first audio 190 such that the wearer of the headphone device 102 does not hear the first audio 190. Additionally, the audio output by the speaker 110 may amplify the second audio 192 such that the wearer of the headphone device 102 more clearly hears the second audio 192. As a result, the headphone device 102 enables directional active noise cancellation. For example, the headphone device 102 suppresses noise originating from the first direction and amplifies noise originating from the second direction. In some implementations, a feedback microphone 160 is configured to capture audio at an output of the speaker 110 and to provide a feedback signal 162 to the ANC circuit 108. The ANC circuit 108 may process the feedback signal 162 to improve noise cancellation, such as to cancel noise that enters the headphone due to an incomplete seal between the headphone and the user's head or ear.

Although FIGS. 1A and 1B illustrate two feedforward microphones 104, 106, in other implementations three or more feedforward microphones may be used to improve a resolution or accuracy of directional noise cancellation. For example, beamforming may be performed using an array of feedforward microphones. Although FIG. 1A depicts the headphone device 102 in an over-the-ear configuration, in other implementations the headphone device 102 has other configurations, such as an on-ear configuration or an in-ear configuration.

Although FIG. 1B illustrates an implementation that includes the wireless receiver 142 and the input device 144, in other implementations one or both of the wireless receiver 142 and the input device 144 is omitted. For example, the headphone device 102 may be configured to perform noise cancellation in the first direction and may not be adjustable to perform omni-directional noise cancellation or to perform noise cancellation in the second direction. Although a feedback microphone 160 is illustrated, in other implementations the feedback microphone 160 is omitted and the headphone device 102 operates in a feedforward-only mode. The combiner 152 can be omitted in implementations in which the headphone device 102 is used for noise cancellation only and not for audio playback. The phase detector 122 can similarly be omitted, such as in an implementation in which the feedforward microphones 104, 106 are directional and the speaker housing 103 is acoustically insulating.

Figure 2:
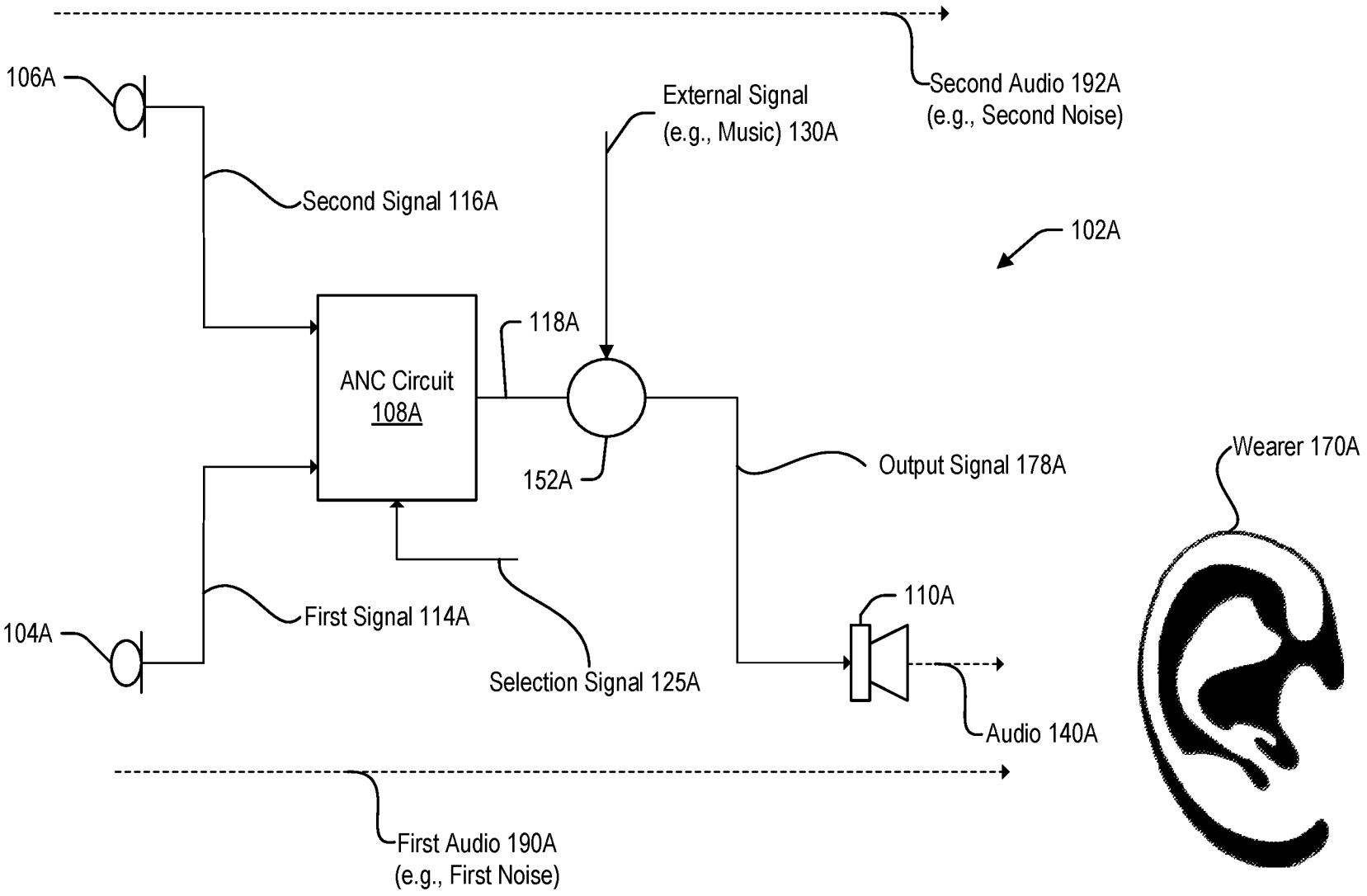
FIG. 2 is another example of a headphone device that is operable to perform directional noise cancellation.

Referring to FIG. 2, an example of a headphone device 102A is shown. According to one implementation, the headphone device 102A corresponds to the headphone device 102 in FIGS. 1A and 1B. The headphone device 102A includes a first feedforward microphone 104A, a second feedforward microphone 106A, an ANC circuit 108A, a combiner 152A, and a speaker 110A.

The first feedforward microphone 104A is configured to capture first audio 190A (e.g., first noise) and generate a first signal 114A based on the captured first audio 190A. According to one implementation, the first signal 114A is a digital signal that has properties (e.g., characteristics) that are representative of the first audio 190A. For example, the first feedforward microphone 104A may include an analog-to-digital convertor that converts an analog signal (e.g., the captured first audio 190A) to a digital signal (e.g., the first signal 114A). The first signal 114A is provided to the ANC circuit 108A.

The second feedforward microphone 106A is configured to capture second audio 192A (e.g., second noise) and generate a second signal 116A based on the captured second audio 192A. According to one implementation, the second signal 116A is a digital signal that has properties (e.g., characteristics) that are representative of the second audio 192A. For example, the second feedforward microphone 106A may include an analog-to-digital convertor that converts an analog signal (e.g., the captured second audio 192A) to a digital signal (e.g., the second signal 116A). The second signal 116A is also provided to the ANC circuit 108A.

The ANC circuit 108A is configured to generate an anti-noise signal 118A based on the first signal 114A and the second signal 116A. For example, a selection signal 125A is provided to the ANC circuit 108A. According to one implementation, the selection signal 125A corresponds to the selection signal 125 of FIG. 1B. If the selection signal 125A has a first value, the ANC circuit 108A is responsive to the first value of the selection signal 125A to apply a noise cancellation operation on the first signal 114A and to apply a pass-through operation on the second signal 116A. If the selection signal 125A has a second value, the ANC circuit 108A is responsive to the second value of the selection signal 125A to apply the noise cancellation operation on the second signal 116A and to apply the pass-through operation on the first signal 114A.

The anti-noise signal 118A is provided to the combiner 152A. The combiner 152A is configured to combine the anti-noise signal 118A with an external signal 130A (e.g., music generated by the headphone device 102A) to generate an output signal 178A. The output signal 178A is provided to the speaker 110A, and the speaker 110A is configured to output audio 140A based on the output signal 178A. The output audio 140A may include properties of the anti-noise signal 118A to suppress external noise (e.g., the first audio 190A or the second audio 192A) based on the selection signal 125A. For example, if the selection signal 125A has the first value, the output audio 140A includes properties that suppress the first audio 190A so that a wearer 170A of the headphone device 102A does not hear the first audio 190A. If the selection signal 125A has the second value, the output audio 140A includes properties that suppress the second audio 192A so that the wearer 170A does not hear the second audio 192A.

Thus, during operation, the wearer 170A of the headphone device 102A may control the headphone device 102A to provide directional noise cancellation. For example, a jogger may adjust a control to suppress noise (e.g., the first audio 190A) originating from the front (e.g., within the jogger's sight) but to not suppress noise (e.g., the second audio 192A) originating from behind (e.g., outside of the jogger's sight), providing the jogger with an enhanced experience due to reduced noise from noise sources visible to the jogger without compromising the jogger's safety by cancelling noise from unseen noise sources (e.g., a car approaching behind the jogger).

Figure 3:
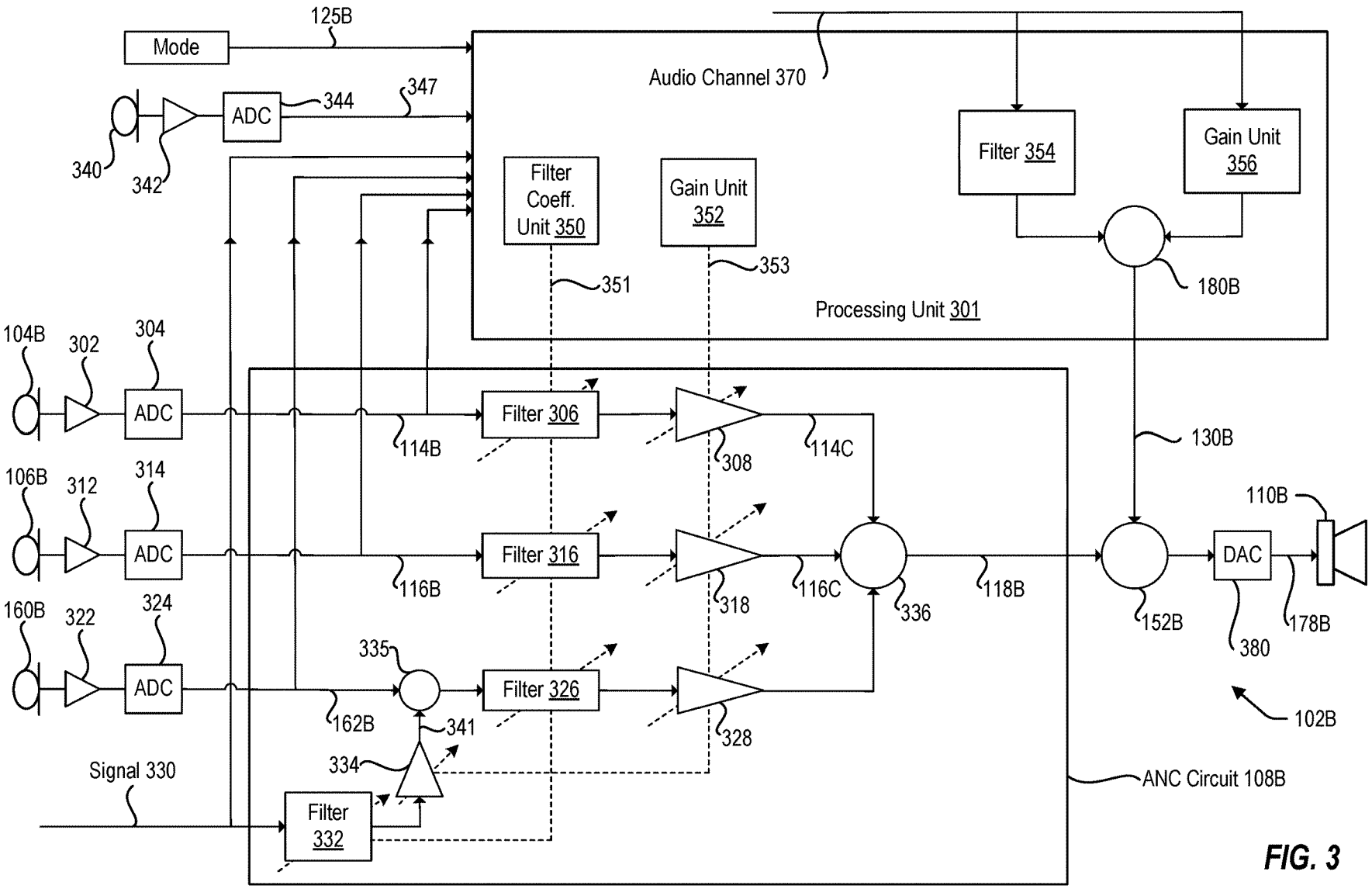
FIG. 3 is another example of a headphone device that is operable to perform directional noise cancellation.

Referring to FIG. 3, another example of a headphone device 102B is shown. According to one implementation, the headphone device 102B corresponds to the headphone device 102 of FIGS. 1A and 1B. According to another implementation, the headphone device 102B corresponds to the headphone device 102A of FIG. 2. The headphone device 102B includes an ANC circuit 108B, a processing unit 301, a speaker 110B, a digital-to-analog convertor (DAC) 380, a combiner 152B, and a plurality of audio capture components.

A feedforward microphone 104B is coupled to a low noise amplifier (LNA) 302, and the LNA 302 is coupled to an analog-to-digital convertor (ADC) 304. The feedforward microphone 104B is configured to capture first noise (e.g., the first audio 190) and the LNA 302 is configured to amplify the first captured noise. The ADC 304 is configured to convert the first amplified captured noise from analog to digital to generate a first signal 114B. The first signal 114B may have similar properties (e.g., characteristics) as the first noise. According to one implementation, the first signal 114B corresponds to the first signal 114 of FIG. 1A. The first signal 114B is provided to a filter 306 within the ANC circuit 108B and to the processing unit 301.

A feedforward microphone 106B is coupled to a LNA 312, and the LNA 312 is coupled to an ADC 314. The feedforward microphone 106B is configured to capture second noise (e.g., the second audio 192) and the LNA 312 is configured to amplify the second captured noise. The ADC 314 is configured to convert the second amplified captured noise from analog to digital to generate a second signal 116B. The second signal 116B may have similar properties (e.g., characteristics) as the second noise. According to one implementation, the second signal 116B corresponds to the second signal 116 of FIG. 1A. The second signal 116B is provided to a filter 316 within the ANC circuit 108B and to the processing unit 301.

The processing unit 301 includes a filter coefficient unit 350 and a gain unit 352. The filter coefficient unit 350 and the gain unit 352 are responsive to a selection signal 125B to generate filter coefficients 351 and gain adjustment parameters 353, respectively. To illustrate, the filter coefficient unit 350 is responsive to a first value of the selection signal 125A to provide noise cancellation filter coefficients 351 to the filter 306. The filter 306 filters the first signal 114B using the noise cancellation filter coefficients 351 to generate a signal 114C (e.g., a filtered signal) that substantially suppresses noise captured by the first feedforward microphone 104B. Additionally, the gain unit 352 is responsive to the first value of the selection signal 125A to provide gain adjustment parameters 353 to a gain amplifier 318 of the ANC circuit 108B. The gain amplifier 318 applies the gain adjustment parameters 353 to the second signal 116B to generate a signal 116C (e.g., an amplified signal) that amplifies the sound captured by the second feedforward microphone 106B.

For ease of illustration, the headphone device 102B of FIG. 3 is described with respect to a first mode (e.g., the selection signal 125B having the first value). However, it should be understood that in other implementations, the headphone device 102B may operate according to a second mode (e.g., the selection signal 125B having a second value). In this scenario, the filter coefficient unit 350 provides the noise cancellation filter coefficients 351 to the filter 316, and the filter 316 filters the second signal 116B using the noise cancellation filter coefficients 351. Additionally, the gain unit 352 provides the gain adjustment parameters 353 to a gain amplifier 308 of the ANC circuit 108B, and the gain amplifier 308 applies the gain adjustment parameters 353 to amplify the first signal 114B.

The signals 114C, 116C are provided to a combiner 336. The combiner 336 combines the signals 114C, 116C to generate an anti-noise signal 118B. According to one implementation, the anti-noise signal 118B corresponds to the anti-noise signal 118A of FIG. 2. The anti-noise signal 118B is provided to the combiner 152B.

A voice microphone 340 is coupled to an LNA 342, and the LNA 342 is coupled to an ADC 344. The voice microphone 340 is configured to capture audio (e.g., speech) from the wearer of the headphone device 102B and the LNA 342 is configured to amplify the captured speech. The ADC 344 is configured to convert the amplified captured speech from analog to digital to generate a signal 347. An audio channel 370 is provided to a filter 354 and a gain unit 356. According to one implementation, the audio channel 370 includes the signal 347. According to another implementation, the audio channel 370 includes external music. The filter 354 filters the audio channel 370 and the gain unit 356 amplifies the audio channel 370. The filtered audio channel and the amplified audio channel 370 are combined by a combiner 180B to generate an external signal 130B. According to one implementation, the external signal 130B corresponds to the external signal 130A of FIG. 2.

The combiner 152B is configured to combine the anti-noise signal 118B with the external signal 130B, and the DAC 380 converts the combined signal from digital to analog to generate an output signal 178B. The output signal 178B is provided to the speaker 110B, and the speaker 110B is configured to output audio based on the output signal 178B. The output audio may include properties of the anti-noise signal 118B to suppress external noise based on the selection signal 125B.

Thus, during operation, the wearer 170 of the headphone device 102B may control the headphone device 102B to provide directional noise cancellation. For example, a jogger may adjust a control to suppress noise originating from the front (e.g., within the jogger's sight) but to not suppress noise originating from behind (e.g., outside of the jogger's sight), providing the jogger with an enhanced experience due to reduced noise from noise sources visible to the jogger without compromising the jogger's safety by cancelling noise from unseen noise sources (e.g., a car approaching behind the jogger).

According to one implementation, a feedback microphone 160B is coupled to a LNA 322, and the LNA 322 is coupled to an ADC 324. The feedback microphone 160B is configured to capture audio at an output of the speaker 110B and the LNA 322 is configured to amplify the captured audio output. The ADC 324 is configured to convert the amplified captured audio from analog to digital to generate a feedback signal 162B to the ANC circuit 108B. According to one implementation, the feedback signal 162B corresponds to the feedback signal 162 of FIG. 1B. The ANC circuit 108B may process the feedback signal 162B to improve noise cancellation, such as to cancel noise that enters the headphone due to an incomplete seal between the headphone and the user's head or ear.

For example, a signal 330 is provided to a filter 332 (e.g., an error correction filter) of the ANC circuit 108B. The signal 330 corresponds to a digital signal that represents previously captured noise at the headphone device 102B. For example, the signal 330 may correspond to noise previously captured by the first feedforward microphone 104B, the second feedforward microphone 106B, or both. The filter 332 is configured to perform error correction filtering on the signal 330 using one or more filter coefficients 351 generated by the filter coefficient unit 350. Additionally, or in the alternative, a gain amplifier 334 of the ANC circuit 108B is configured to amplify the signal 330 based on one or more gain adjustment parameters 353 generated by the gain unit 352. The resulting signal 341 is provided to a combiner 335 with the feedback signal 162B. The combiner 335 combines the feedback signal 162B and the resulting signal 341. The combined signal is provided as an input to a filter 326, and an output of the filter 326 is provided as an input to a gain amplifier 328. An output of the gain amplifier 328 is provided as an input to the combiner 336.

Figure 4:
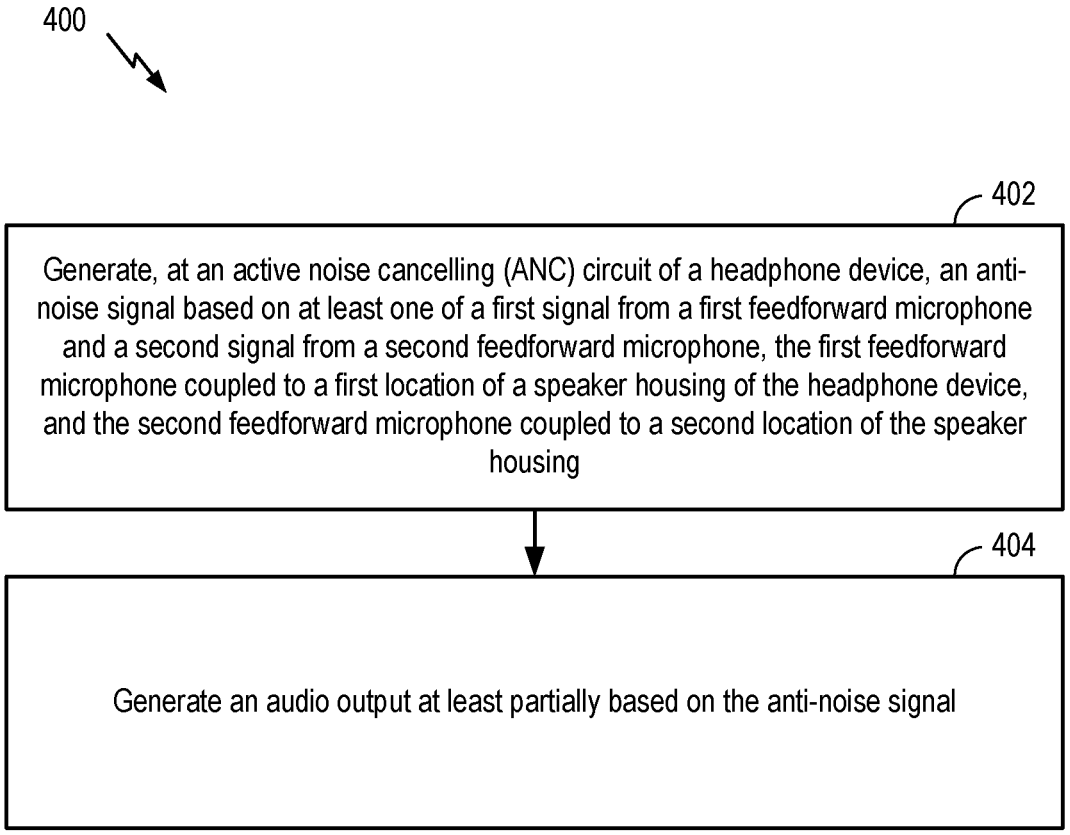
FIG. 4 is a flowchart of a method for performing directional noise cancellation.

Referring to FIG. 4, a method 400 for performing directional active noise cancelling is shown. The method 400 may be performed by the headphone device 102, the ANC circuit 108, the ANC circuit 108A, the headphone device 102A, the headphone device 102B, or a combination thereof.

The method 400 includes generating, at an ANC circuit of a headphone device, an anti-noise signal based on at least one of a first signal from a first feedforward microphone and a second signal from a second feedforward microphone, at 402. The first feedforward microphone is coupled to a first location of a speaker housing of the headphone device, and the second feedforward microphone is coupled to a second location of the speaker housing. For example, referring to FIG. 1A, the ANC circuit 108 generates the anti-noise signal 118 based on at least one of the first signal 114 from the first feedforward microphone 104 and the second signal 116 from the second feedforward microphone 106.

The method 400 also includes generating an output at least partially based on the anti-noise signal, at 404. For example, referring to FIG. 1B, the anti-noise signal 118 includes a signal to substantially suppress noise from the first feedforward microphone 104 and a pass-through signal to amplify audio from the second feedforward microphone 106. The anti-noise signal 118 is provided to the combiner 152, and the combiner 152 combines the anti-noise signal 118 with the external signal 130 to generate the output signal 178. The speaker 110 outputs audio associated with the output signal 178. The audio output by the speaker 110 substantially suppresses the first audio 190 such that the wearer of the headphone device 102 does not hear the first audio 190. Additionally, the audio output by the speaker 110 may amplify the second audio 192 such that the wearer of the headphone device 102 more clearly hears the second audio 192. As a result, the headphone device 102 enables directional active noise cancellation. For example, the headphone device 102 may suppress noise originating from the first direction and pass-through or amplify noise originating from the second direction.

According to one implementation, the method 400 includes generating a selection signal based on a user input. The selection signal indicates whether noise cancellation operations associated with the anti-noise signal are based on the first signal, the second signal, or both. For example, referring to FIG. 1B, the selection circuit 124 generates the selection signal 125 based on user input from the user input device 144. The selection signal 125 indicates whether noise cancellation operations are based on the first signal 114, the second signal 116, or both.

According to one implementation, the method 400 also includes receiving an indication of a value of the selection signal. In response to receiving a first value of the selection signal, the method 400 includes applying a noise cancellation operation to the first signal. For example, to perform noise reduction on the first audio 190, the ANC circuit 108 may apply a noise cancellation operation to the first signal 114. To illustrate, the first value of the selection signal 125 may enable filter coefficients (e.g., IIR coefficients) to control filtering of the first signal 114. The ANC circuit 108 applies the filter coefficients to the first signal 114 to generate a first filtered signal (not shown). The first filtered signal corresponds to a first portion of the anti-noise signal 118 output by the ANC circuit 108. When output by the speaker 110, audio related to the first filtered signal substantially suppresses the first audio 190 such that the wearer of the headphone device 102 does not hear (or hears a reduced amount of) the first audio 190.

Additionally, in response to receiving the first value of the selection signal, the method 400 may include applying a pass-through operation to the second signal. The pass-through operation may include amplifying an audio signal that originates from a non-selected direction for noise cancellation. For example, the ANC circuit 108 applies one or more gain amplifier parameters to the second signal 116 to perform noise reduction on the first audio 190 if the selection signal 125 has the first value. The ANC circuit 108 applies the gain amplifier parameters to the second signal 116 to generate a second amplified signal (not shown). The second amplified signal corresponds to a second portion of the anti-noise signal output by the ANC circuit 108. When output by the speaker 110, audio related to the second amplified signal amplifies the second audio 192 such that the wearer of the headphone device 102 more clearly hears the second audio 192.

The method 400 of FIG. 4 enables directional noise cancellation at a headphone device. For example, a jogger may adjust a control to suppress noise originating from the front (e.g., within the jogger's sight) but to not suppress noise originating from behind (e.g., outside of the jogger's sight), providing the jogger with an enhanced experience due to reduced noise from noise sources visible to the jogger without compromising the jogger's safety by cancelling noise from unseen noise sources (e.g., a car approaching behind the jogger).

Figure 5:
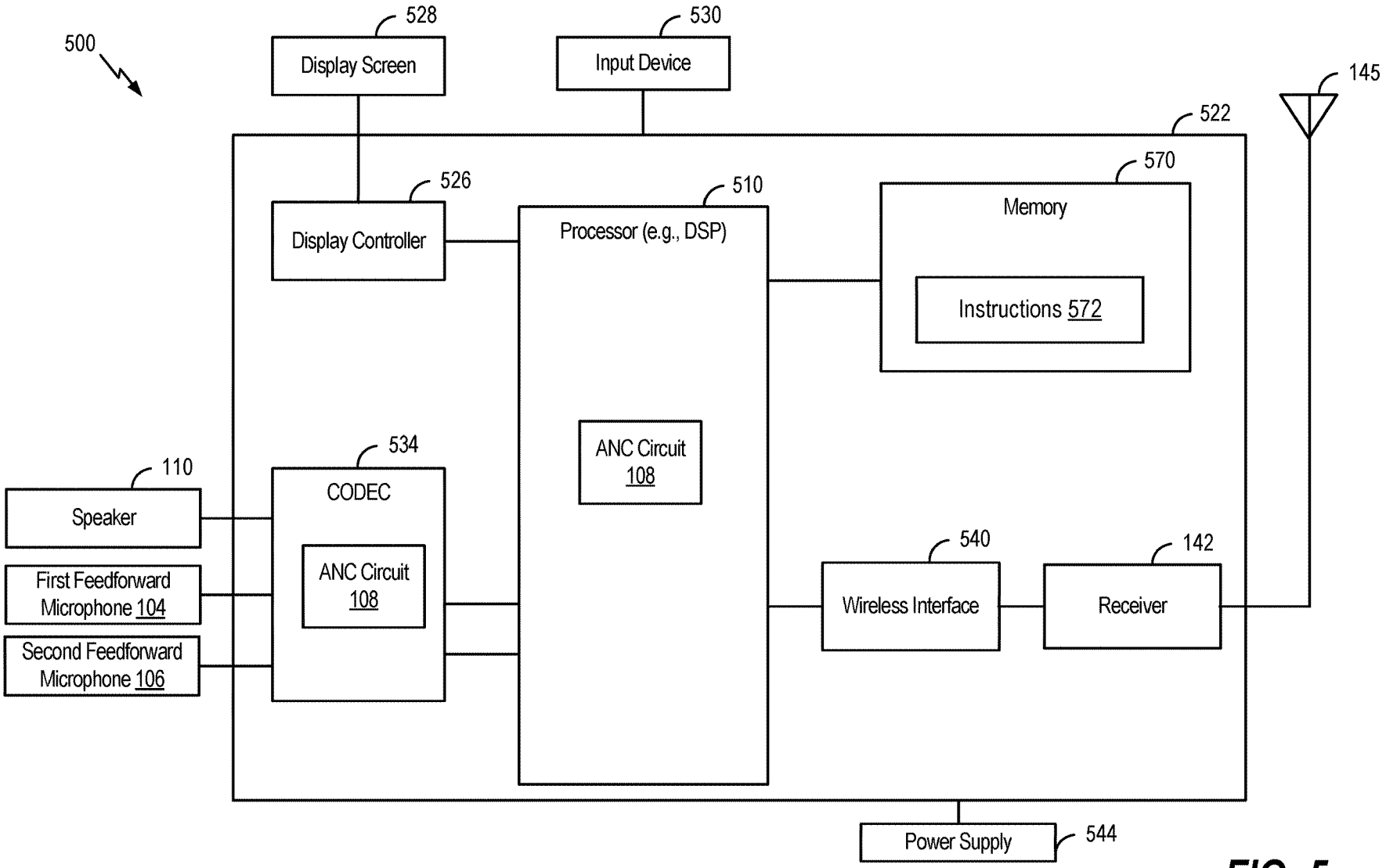
FIG. 5 is a block diagram of a particular illustrative example of a mobile device that is operable to perform the techniques described with reference to FIGS. 1A-4.

Referring to FIG. 5, a block diagram of a particular illustrative implementation of a mobile device 500 (e.g., a wireless communication device) is shown. In various implementations, the mobile device 500 may have more components or fewer components than illustrated in FIG. 5. In a particular implementation, the mobile device 500 includes a processor 510, such as a central processing unit (CPU) or a digital signal processor (DSP), coupled to a memory 570. The memory 570 includes instructions 572 (e.g., executable instructions) such as computer-readable instructions or processor-readable instructions. The instructions 572 may include one or more instructions that are executable by a computer, such as the processor 510.

FIG. 5 also illustrates a display controller 526 that is coupled to the processor 510 and to a display screen 528. A coder/decoder (CODEC) 534 may also be coupled to the processor 510. According to one implementation, the CODEC 534 includes the ANC circuit 108. According to another implementation, the processor 510 includes the ANC circuit 108. A speaker 536, the first feedforward microphone 104, and the second feedforward microphone 106 are coupled to the CODEC 534. According to one implementation, the mobile device 500 corresponds to the headphone device 102, and the CODEC 534, the speaker 110, the first feedforward microphone 104, and the second feedforward microphone 106 are integrated into the headphone device 102. FIG. 5 further illustrates that a wireless interface 540, such as a wireless controller, and the receiver 142 may be coupled to the processor 510 and to the antenna 145, such that wireless data received via the antenna 145, the receiver 142, and the wireless interface 540 may be provided to the processor 510.

In some implementations, the processor 510, the display controller 526, the memory 570, the CODEC 534, the wireless interface 540, and the receiver 142 are included in a system-in-package or system-on-chip device 522. In some implementations, an input device 530 and a power supply 544 are coupled to the system-on-chip device 522. Moreover, in a particular implementation, as illustrated in FIG. 5, the display screen 528, the input device 530, the speaker 110, the first feedforward microphone 104, the second feedforward microphone 106, the antenna 145, and the power supply 544 are external to the system-on-chip device 522. In a particular implementation, each of the display screen 528, the input device 530, the speaker 110, the first feedforward microphone 104, the second feedforward microphone 106, the antenna 145, and the power supply 544 may be coupled to a component of the system-on-chip device 522, such as an interface or a controller.

The mobile device 500 may include a headset, a smart watch, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a component of a vehicle, or any combination thereof, as illustrative, non-limiting examples.

In an illustrative implementation, the memory 570 may include or correspond to a non-transitory computer readable medium storing the instructions 572. The instructions 572 may include one or more instructions that are executable by a computer, such as the processor 510 or the CODEC 534. The instructions 572 may cause the processor 510 or the CODEC 534 to perform the method 400 of FIG. 4.

One or more components of the mobile device 500 may be implemented via dedicated hardware (e.g., circuitry), by a processor executing instructions to perform one or more tasks, or a combination thereof. As an example, the memory 570 or one or more components of the processor 510, and/or the CODEC 534 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 572) that, when executed by a computer (e.g., a processor in the CODEC 534 or the processor 510), may cause the computer to perform one or more operations described with reference to FIGS. 1A-4.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a headphone device includes means for capturing first noise from a first direction. For example, the means for capturing may include the first feedforward microphone 104, the first feedforward microphone 104A, the first feedforward microphone 104B, one or more other devices, sensors, circuits, modules, sensors, or any combination thereof.

The headphone device may also include means for capturing second noise from a second direction. For example, the means for capturing may include the second feedforward microphone 106, the second feedforward microphone 106A, the second feedforward microphone 106B, one or more other devices, sensors, circuits, modules, sensors, or any combination thereof.

The headphone device may also include means for generating an anti-noise signal based on at least one of a first signal from the means for capturing the first noise and a second signal from the means for capturing the second noise. For example, the means for generating the anti-noise signal may include the ANC circuit 108, the ANC circuit 108A, the ANC circuit 108B, the CODEC 534, the processor 510, the instructions 572 executable by a processing device, one or more other devices, circuits, modules, sensors, or any combination thereof.

The headphone device may also include means for generating an audio output at least partially based on the anti-noise signal. For example, the means for generating the audio may include the speaker 110, the speaker 110A, the speaker 110B, one or more other devices, circuits, modules, sensors, or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A headphone device comprising:

a speaker housing;

a first feedforward microphone coupled to the speaker housing at a first location;

a second feedforward microphone coupled to the speaker housing at a second location;

an active noise cancelling (ANC) circuit configured to generate an anti-noise signal based on at least one of a first signal from the first feedforward microphone and a second signal from the second feedforward microphone;

an input device coupled to the speaker housing, wherein a value of a selection signal is determined based on input from the input device, the selection signal indicating whether noise cancellation operations associated with the anti-noise signal are based on the first signal, the second signal, or both; and a speaker configured to generate an audio output based in part on the anti-noise signal.

2. The headphone device of claim 1, further comprising a control circuit that is configured to provide the selection signal to the ANC circuit.

3. The headphone device of claim 1, wherein the selection signal is a user selected selection signal received via the input device.

4. The headphone device of claim 2, wherein the input device comprises a wireless receiver, and wherein the control circuit is configured to receive an indication of a value of the selection signal from the wireless receiver.

5. The headphone device of claim 2, wherein the ANC circuit is responsive to a first value of the selection signal to apply a noise cancellation operation to the first signal and to apply a pass-through operation to the second signal, and wherein the ANC circuit is responsive to a second value of the selection signal to apply the noise cancellation operation to the second signal and to apply the pass-through operation to the first signal.

6. The headphone device of claim 5, wherein the pass-through operation includes amplifying an audio signal that originates from a non-selected direction for noise cancellation.

7. The headphone device of claim 2, wherein the control circuit is configured to generate the selection signal further based on a phase difference between capture of an audio signal at the first feedforward microphone and capture of the audio signal at the second feedforward microphone.

8. The headphone device of claim 1, further comprising a feedback microphone configured to provide a feedback signal to the ANC circuit.

9. A method comprising:

generating, at an active noise cancelling (ANC) circuit of a headphone device, an anti-noise signal based on at least one of a first signal from a first feedforward microphone and a second signal from a second feedforward microphone, the first feedforward microphone coupled to a first location of a speaker housing of the headphone device, and the second feedforward microphone coupled to a second location of the speaker housing;

receiving an indication of a value of a selection signal based on user selected input from an input device, the selection signal indicating whether noise cancellation operations associated with the anti-noise signal are based on the first signal, the second signal, or both; and generating an audio output based in part on the anti-noise signal.

10. The method of claim 9, wherein the indication is received from a wireless receiver.

11. The method of claim 9, further comprising, in response to receiving a first value of the selection signal:

applying a noise cancellation operation to the first signal; and applying a pass-through operation to the second signal.

12. The method of claim 11, further comprising, in response to receiving a second value of the selection signal:

applying the noise cancellation operation to the second signal; and applying the pass-through operation to the first signal.

13. The method of claim 12, wherein the pass-through operation includes amplifying an audio signal that originates from a non-selected direction for noise cancellation.

14. The method of claim 9, wherein the selection signal is further based on a phase difference between capture of an audio signal at the first feedforward microphone and capture of the audio signal at the second feedforward microphone.

15. A non-transitory computer-readable medium comprising instructions that, when executed by a processor within an active noise cancelling (ANC) circuit of a headphone device, cause the processor to perform operations comprising:

generating an anti-noise signal based on at least one of a first signal from a first feedforward microphone and a second signal from a second feedforward microphone, the first feedforward microphone coupled to a first location of a speaker housing of the headphone device, and the second feedforward microphone coupled to a second location of the speaker housing;

receiving an indication of a value of a selection signal based on user selected input from an input device, the selection signal indicating whether noise cancellation operations associated with the anti-noise signal are based on the first signal, the second signal, or both; and generating an audio output based in part on the anti-noise signal.

16. The non-transitory computer-readable medium of claim 15, wherein the indication is received from a wireless receiver.

17. The non-transitory computer-readable medium of claim 15, wherein, in response to the selection signal having a first value, the operations further comprise:

applying a noise cancellation operation to the first signal; and applying a pass-through operation to the second signal.

18. The non-transitory computer-readable medium of claim 17, wherein, in response to the selection signal having a second value, the operations further comprise:

applying the noise cancellation operation to the second signal; and applying the pass-through operation to the first signal.

19. The non-transitory computer-readable medium of claim 18, wherein the pass-through operation includes amplifying an audio signal that originates from a non-selected direction for noise cancellation.

20. The non-transitory computer-readable medium of claim 15, wherein the selection signal is further based on a phase difference between capture of an audio signal at the first feedforward microphone and capture of the audio signal at the second feedforward microphone.

21. A headphone device comprising:

means for capturing first noise from a first direction;

means for capturing second noise from a second direction;

means for generating an anti-noise signal based on at least one of a first signal from the means for capturing the first noise and a second signal from the means for capturing the second noise;

means for receiving an input, wherein a value of a selection signal is determined based on input, the selection signal indicating whether noise cancellation operations associated with the anti-noise signal are based on the first signal, the second signal, or both; and means for generating an audio output at least partially based on the anti-noise signal.

22. The headphone device of claim 21, further comprising means for generating a feedback signal based on the audio output.

* * * * *